US009283469B2

(12) United States Patent
Riley et al.

(10) Patent No.: US 9,283,469 B2
(45) Date of Patent: Mar. 15, 2016

(54) IMPACT ABSORBING DASHERBOARD

(71) Applicants: Terence William Riley, Princeton (CA); Sean James Riley, Burlington (CA)

(72) Inventors: Terence William Riley, Princeton (CA); Sean James Riley, Burlington (CA)

(73) Assignee: 1196501 ONTARIO INC., Woodstock, Ontario (CA)

( * ) Notice: Subject to any disclaimer, the term of this patent is extended or adjusted under 35 U.S.C. 154(b) by 0 days.

(21) Appl. No.: 14/396,183

(22) PCT Filed: Apr. 22, 2013

(86) PCT No.: PCT/CA2013/000397

§ 371 (c)(1),
(2) Date: Oct. 22, 2014

(87) PCT Pub. No.: WO2013/159193

PCT Pub. Date: Oct. 31, 2013

(65) Prior Publication Data

US 2015/0151187 A1 Jun. 4, 2015

(30) Foreign Application Priority Data

Apr. 23, 2012 (GB) ..... 1207093.4

(51) Int. Cl.
*A63C 19/08* (2006.01)
*E04H 17/14* (2006.01)
*A63C 19/10* (2006.01)

(52) U.S. Cl.
CPC ..... *A63C 19/10* (2013.01); *A63C 19/08* (2013.01); *E04H 17/14* (2013.01); *A63C 2019/085* (2013.01)

(58) Field of Classification Search
CPC ..... A63C 19/00; A63C 19/08; A63C 19/10; A63C 2019/085; E04H 12/2238; E04H 17/00; E04H 17/1443
USPC ..... 472/88–89, 92, 94; 256/1, 24, 25, 73
See application file for complete search history.

(56) References Cited

U.S. PATENT DOCUMENTS

| | | | | |
|---|---|---|---|---|
| 4,336,291 | A | 6/1982 | Broadhurst et al. | |
| 5,953,882 | A | 9/1999 | Vallance et al. | |
| 6,004,217 | A | 12/1999 | Johnston et al. | |
| 6,155,022 | A * | 12/2000 | DeCanio | A63C 19/08 256/24 |
| 6,622,434 | B1 | 9/2003 | Garrett | |
| 6,783,461 | B2 | 8/2004 | Frazier et al. | |
| 8,696,478 | B2 * | 4/2014 | Kapsalis | A63C 19/10 472/94 |
| 2012/0001139 | A1 | 1/2012 | Riley et al. | |

FOREIGN PATENT DOCUMENTS

| | | |
|---|---|---|
| WO | WO-2012/021105 | 2/2012 |

* cited by examiner

*Primary Examiner* — Kien Nguyen
(74) *Attorney, Agent, or Firm* — Anthony Asquith Corp.

(57) ABSTRACT

Disclosed is a dasher-boards assembly with capability to absorb impacts of players crashing into the boards. The glass pane surmounting the boards can tip away from the ice, against a spring, and then resiliently return to its normal (upright) position. The spring is a bar-spring, which not only is deflectable to provide the resilience, but also has the capability to support and position the pane with respect to the dasher-board. The bar-spring can be used when the pane is flush-mounted with respect to the dasher-board, or when the pane is set-back from the ice-side of the dasher-board.

16 Claims, 10 Drawing Sheets

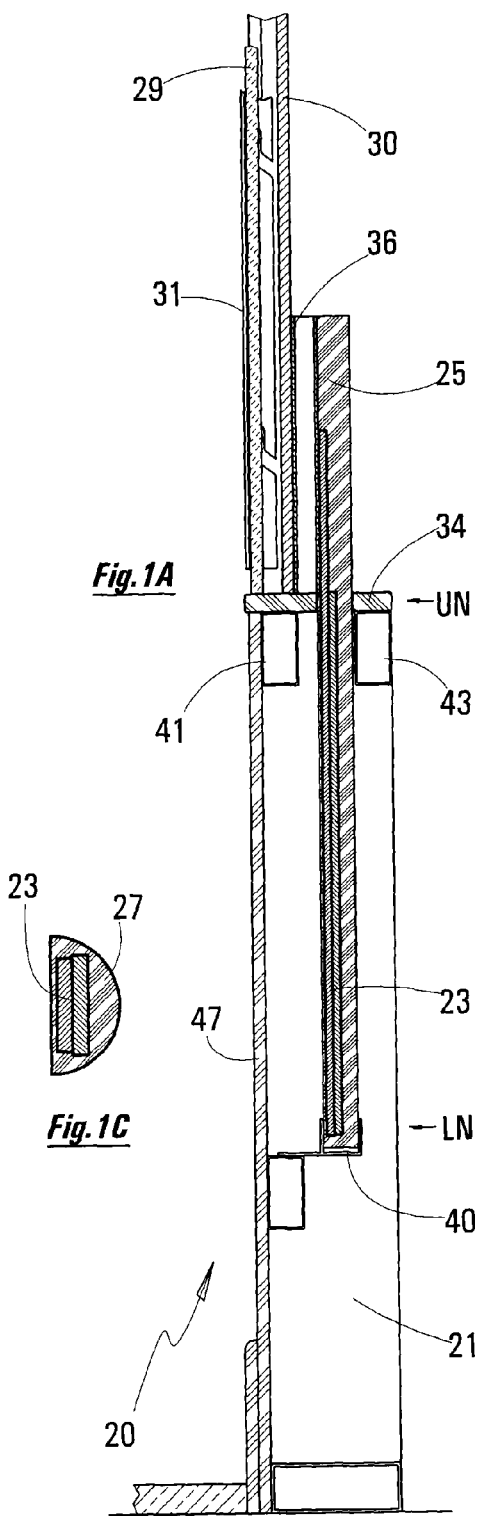
Fig. 1A
Fig. 1C
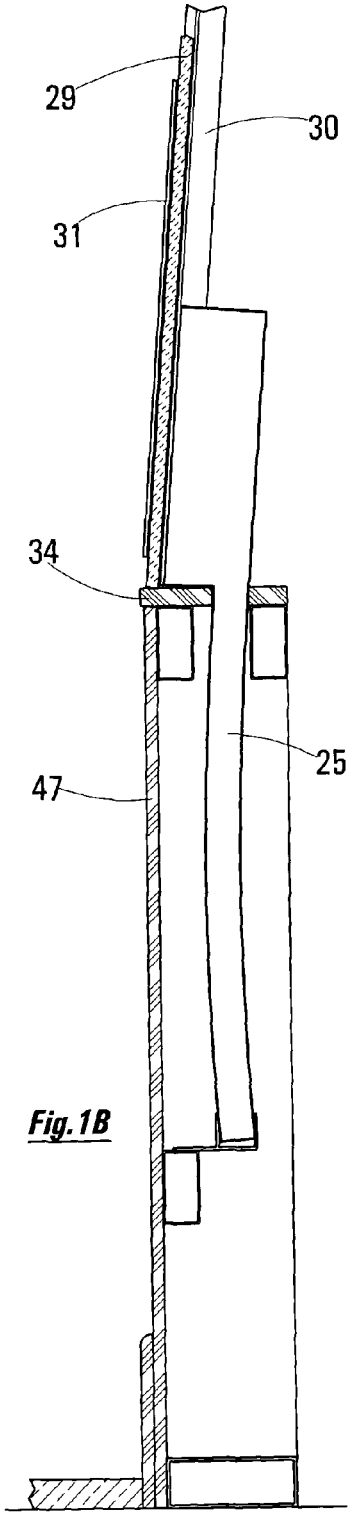
Fig. 1B

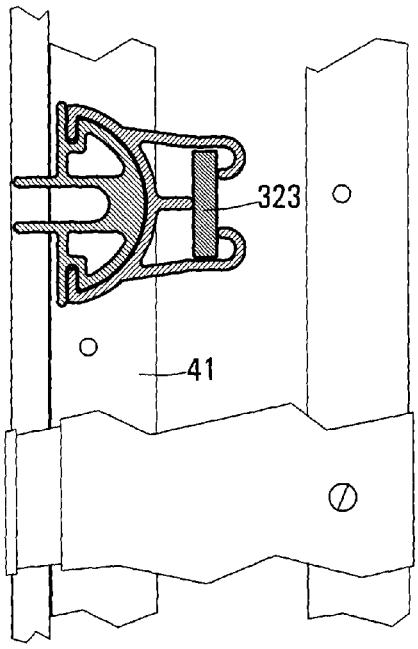
Fig.3A
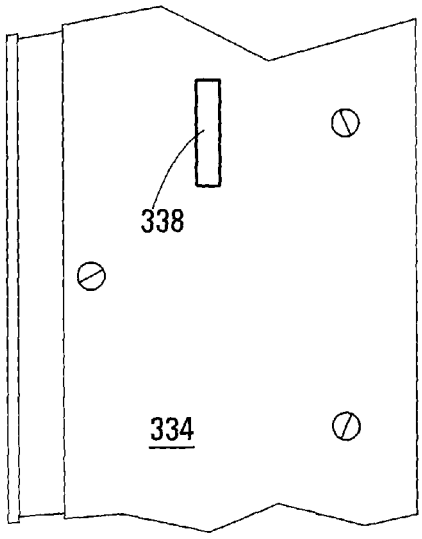
Fig.3B
Fig.2A
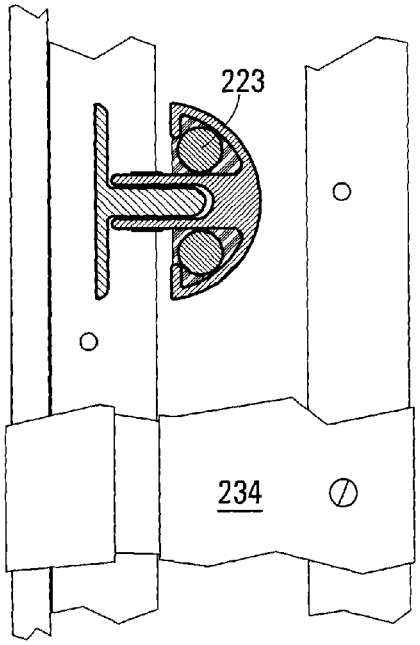
Fig.2B
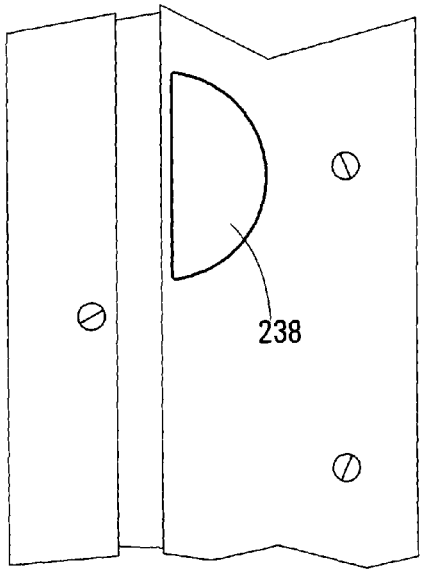

29
56
54
58
438
434
UN
423

654
UN
641
LN

UN
LN

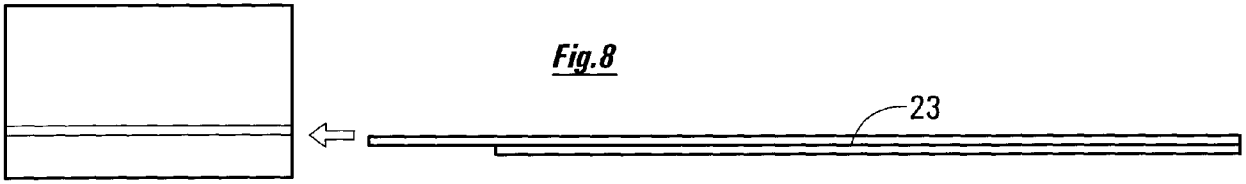
Fig.8
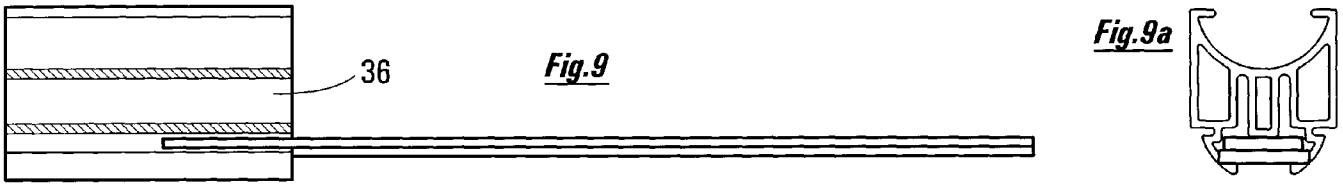
Fig.9
Fig.9a
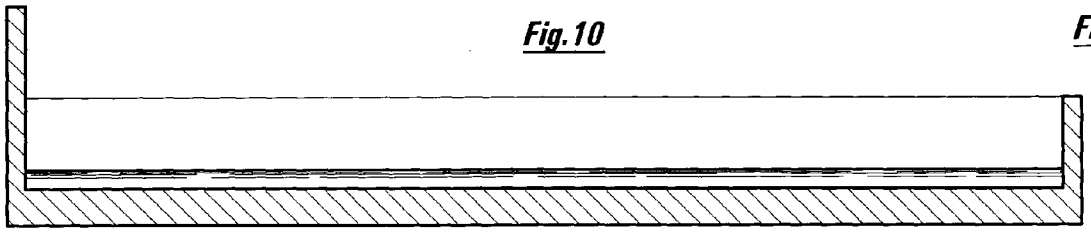
Fig.10
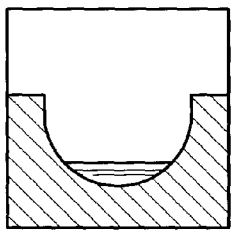
Fig.10a
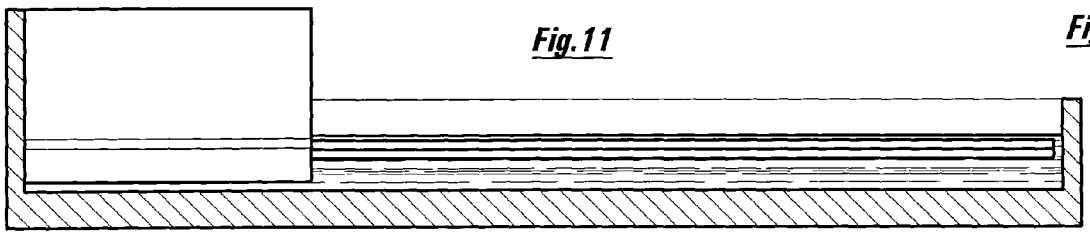
Fig.11
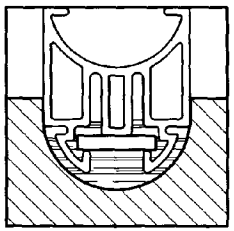
Fig.11a

IMPACT ABSORBING DASHERBOARD

This technology relates to dasher-boards, which surround an ice-rink for the sport of ice-hockey. It is a development from technology shown in patent publication US-2012/0001139, dated 5 Jan. 2012.

The side of the dasher-board that faces towards the ice—being the side that players make contact with, during the game—is referred to as the ice-side or front of the dasher-board. The other side, which faces away from the ice, is referred to as the back of the dasher-board.

The dasher-board assembly is the assembly of dasher-board plus glass panes, with their associated mounting components. For the purposes of this specification, the dasher-board itself does not include the glass. The dasher-board assemblies may be referred to as the Boards.

The dasher-boards extend all the way around the ice-rink. It is made in sections, each section being 2.44 meters wide (measured along the perimeter of the rink). Typically, dasher-boards are 14 cm or 15½ cm overall thickness (including the kick-panel or puck-panel on the ice-side, at the bottom of the dasher-board.)

Around the corners of the rink, typically, the dasher-boards are curved. In some installations (e.g as shown in FIG. 14 of US-2012/0001139), the corner-panes are also curved, corresponding to the curve of the corner-boards. In other installations (e.g as shown in FIG. 15 of US-2012/0001139), the corner-boards are curved but the corner-panes are flat-planar.

The glass panes are made of tempered glass, or of perspex or acrylic or other suitable plastic material. Typically, the panes are 1.22 meters wide, and 1.22 to 2.44 meters high. Usually, the panes around the corners and ends of the rink are higher than the panes along the straight sides of the rink. The glass panes are 12 mm or 15 mm thick. Typically, the corner panes weigh 54 kg to 108 kg, and the smaller panes 46 kg to 205 kg.

In some installations, the assembly includes metal stanchions, which are mounted in, and protrude upwards from, the dasher-boards. The glass panes are mounted in (i.e between) the stanchions. Usually, the stanchions can be detached from the dasher-boards, for the purposes of dismantling and removing the dasher-board assemblies from the rink.

An example of an installation that uses stanchions is shown in FIG. 2 of US-2012/0001139. The dasher-board structure includes front and back top-stringers, and generally the stanchions pass between the two top-stringers, and rest on a mid- or bottom-stringer.

Typically, the stanchions are not positioned at the ends of, i.e between, adjacent dasher-board sections, but rather the stanchions are located well away from the ends of the sections. Thus, some of the panes, supported in the stanchions, span across from section to section.

In other installations, there are no stanchions, but rather the glass panes are received in troughs or channels that are structured into the tops of the dasher-boards. Examples of no-stanchions installations are shown in FIGS. 6,7,13 of US-2012/0001139.

In some installations, the glass panes are set some way back from the front edge of the top-cap of the dasher-board. This positioning makes it easy to support the panes between the two (front and back) top-stringers of the dasher-board, whereby the required strength and robustness of the dasher-board assembly is readily achieved.

However, setting the pane back from the front edge of the top-cap leaves a wide ledge of the upwards-facing top-cap protruding towards the ice—and available for contact with the face and head of a player who happens to be falling at the same time as crashing into the Boards. FIGS. 1,3 of US-2012/0001139 show an example of a (potentially dangerous) wide ledge or land on the ice-side of the top-cap.

In other installations, the glass pane is flush, or almost flush, with the ice-side panel of the dasher-board. FIGS. 4-9 of US-2012/0001139 show examples of flush-mountings, where the exposed land of the ice-side of the top-cap is zero, or very narrow, and thus exposes players to much-reduced risk of injury.

In ice-hockey, players crash into the dasher-board-assemblies, and the Boards have to be robust enough not to be damaged by a player-crash-incident. The Boards also should be so structured that injuries to players arising from such incidents are minimized.

Desirably, the Boards should be structured to have a shock-absorbing function, in which the Boards "give" somewhat, when struck by a player, and resiliently recover after being so struck. Also, the designers should see to it that any relative movements between the various components of the Boards, which might occur during a player-crash-incident, should not open up gaps that could or might pinch the player (or clothing, etc) when the components regain their normal or unstressed juxta-positions.

The present technology is aimed at providing such shock-absorbing resilience, or "give", in a dasher-board assembly, in a manner that minimizes use of resources, while maximizing performance and robustness. The technology can be used when the glass panes are set back (i.e not flush-mounted), but is especially beneficial when the panes are flush-mounted.

It is known (e.g from U.S. Pat. No. 6,004,217) for the dasher-board itself to be so mounted (to the concrete floor of the rink) that the dasher-board can rock back resiliently when the player crashes into the boards. In the same publication, a glass pane is so mounted on the dasher-board that the pane can tip backwards resiliently with respect to the dasher-board.

The present technology is described with reference to the accompanying drawings, in which:

FIGS. 1A-1E are views of a dasher-board assembly that incorporates the new technology.

FIG. 1A is a sectioned side elevation of the assembly.

FIG. 1B is a similar view to FIG. 1A, in which some of the components are not sectioned, and shows a bar-spring undergoing resilient deflection as a result of a player crashing into the board from the left.

FIG. 1C is a view from underneath, of a lower-portion of bar-spring encapsulated in moulded polyurethane.

FIG. 1D is a view from above the dasherboard assembly of FIG. 1A, and shows left and right panes of glass, which are held in place by a stanchion, which is held in place, in turn, by a stanchion-support.

FIG. 1E is a similar view to FIG. 1D, except that the glass, stanchion, and stanchion-support have been removed. Shown in FIG. 4 is an aperture in the top-cap through which the bar-spring is inserted.

FIG. 2A is a view from above of another dasher-board assembly.

FIG. 2B is the same view, with some of the components omitted.

FIG. 3A is a view from above of a further dasher-board assembly.

FIG. 3B is the same view, with some of the components omitted.

FIGS. 8,9,10,11 show stages in the encapsulation of the flexible metal bases in moulded polyurethane.

FIGS. 9A,10A,11A are end-views corresponding to FIGS. 9,10,11.

Figure 1D:
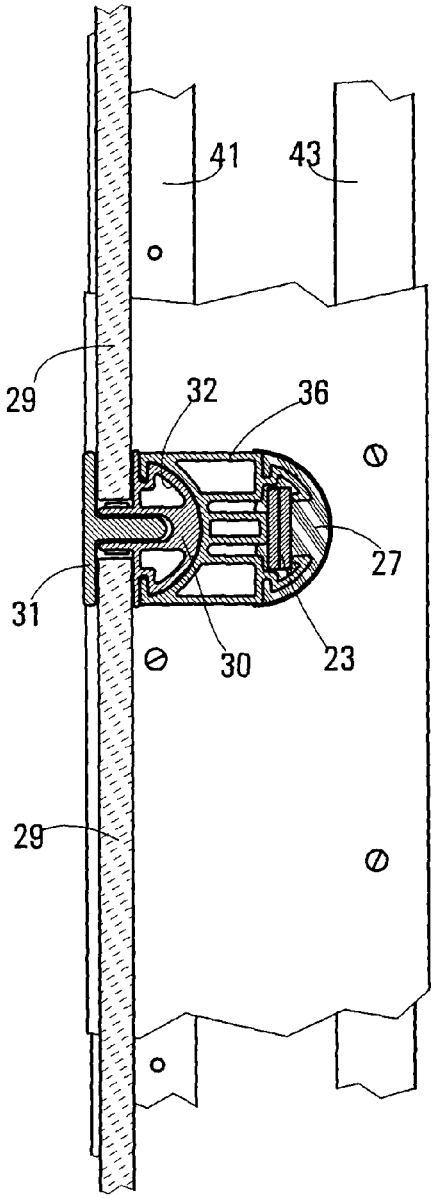

FIG. 1A shows a dasher-board assembly 20, in which flexible (spring-steel) bar-springs 23A,23B engage a pane-carrier in the form of a stanchion-support 25. The bar-springs 23 are adhered to the stanchion-support 25 by a body of plastic 27 in which the bar-springs 23 are encapsulated.

Glass panes 29 are attached to the upright stanchion 30 in the conventional manner. The side-edges of the panes 29 fit into side-grooves created between the cross-sectional form of the stanchion 30 and tee-section retainer-strips 31 that clip onto pins in the stanchion.

The stanchion 30 is an aluminum extrusion, and is received in a socket 32 of the stanchion-support 25. The bottom of the stanchion 30 rests directly on the (plastic) material of a top-cap 34 of the dasher-board 21.

Thus, the stanchion 30 can move in the up/down direction with respect to the stanchion-support 25, but is constrained against all other modes of relative movement by the fact of the engagement of the cross-sectional form of the stanchion 30 with the shaped socket 32. The stanchion-support 25 preferably does not itself support the weight of the stanchion 30 (although it could). The stanchion-support 25, the stanchion 30, and the glass panes 29, all rest directly on the top-cap 34 of the dasher-board 21.

The stanchion-support 25 is a composite or sub-assembly, the components of which include (a) a stanchion-base 36 in the form of an aluminum extrusion, in which is formed the socket 32 that receives the stanchion 30; (b) the flexible bar-springs 23, of which one (or both) are inserted into suitable orifices in the extruded form of the stanchion-base 36; and (c) the plastic encapsulation 27.

The encapsulated bar-springs 23 that form the lower part of the stanchion-support 25 pass through an aperture 38 that has been formed in the top-cap 34. The foot of the stanchion-support 25 is contained in a fixed receptacle 40, which is built into the frame of the dasher-board 21.

FIG. 1B shows the manner in which glass pane 29 moves, and the stanchion-support 25 (including the flexible bar-springs 23) deflect in response to an impact (from the left), as may be caused by a player crashing into the dasher-board assembly 20. As can be seen, the main span of the bar-springs 23 bows forwards, in the direction towards the ice. The upper part of the stanchion-support 25, including the stanchion-base 36 and the tops of the bar-springs 23, angle backwards, following the tipping or pivoting of the glass-pane 29.

Figure 1E:
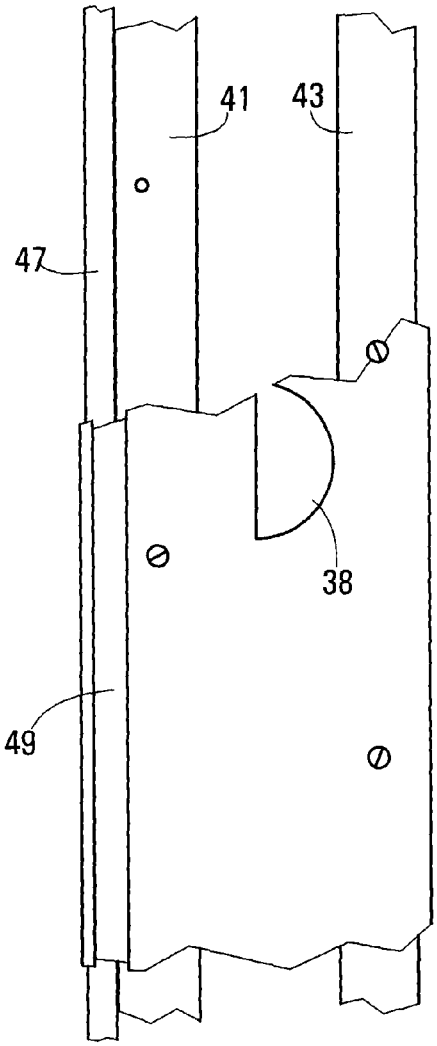

As shown in FIGS. 1D,1E, the lower-portion of the stanchion-support 25 fits through an aperture 38 in the top-cap 34. The profile of the lower-portion (comprising the encapsulated bar-springs, FIG. 1C) of the stanchion-support 25 is a clearance fit in the aperture 38. The aperture is cut to correspond to the size and shape of the encapsulated bar-springs. The aperture 38 in the top-cap 34 is large enough to allow the lower-portion of the stanchion-support 25 to pass through, but is tight enough that the stanchion-support 25 cannot move significantly within the aperture 38.

It is not essential that the sides of the aperture 38 in the top-cap 34 must constrain the lower-portion in all directions in which the same might move, in that other portions, e.g the top stringers 41,43 (or brackets attached to the top stringers) of the dasher-board 21 can provide positioning containment, for holding the stanchion-support 25—and the stanchion 30—in the desired location in the dasher-board frame.

As shown in FIGS. 2A,2B, the flat bar-springs 23 are replaced by round bar-springs 223. As shown, the round bar-springs 223 are encapsulated in polyurethane, in the same manner as the flat bar-springs 23.

In the assembly of FIGS. 1A-1E, the glass panes 29 are flush (or almost flush) with the front-panel 47 of the dasher-board 21. However, it is common, in hockey rinks, for the glass-panes to be set back from the front surface, whereby a ledge or land of the top-cap 34 exists on the ice-side of the glass panes. This land or ledge can be e.g five cm wide or more, and thus can pose a danger to the face and head of a player who might happen to be falling at the moment of crashing into the boards. Flush-mounting is shown e.g in US-2012/0001139. The flush-mounting of the glass-panes eliminates or reduces the danger.

Non-flush (set-back, wide-ledge) glass mountings are common. In FIGS. 2A,2B, the glass-panes are set back, i.e are not flush-mounted. This reduces the need for a stanchion-base, as a component or unit that is separate from the stanchion itself. In FIGS. 2A,2B, the profile of the stanchion now fits between the two top-stringers—unlike FIGS. 1A-1E where the stanchion profile overlies the ice-side top-stringer 41. In FIGS. 1-4, the configuration of the stanchion-support enables the bar-springs to pass down between the top-stringers, even though the stanchion itself overlies the ice-side top-stringer.

The FIGS. 3A,3B design is similar to that of FIGS. 1A-1E, in that the glass panes are flush-mounted, and in that a stanchion-support is used to enable the stanchion to overlie the ice-side top stringer 41. In FIGS. 3A,3B, there is no plastic encapsulation of the bar-springs. In fact, only one bar-spring 323 is provided. Now, since the bar-spring 323 is not held in place by the encapsulation, the bar-spring should be a tight (interference) fit into the stanchion-base 336 of the stanchion-support 325. In fact, it can be advisable for the bar-spring to be a tight fit in the profile of the stanchion-support (or stanchion) even when plastic encapsulation is provided.

Figure 3C:
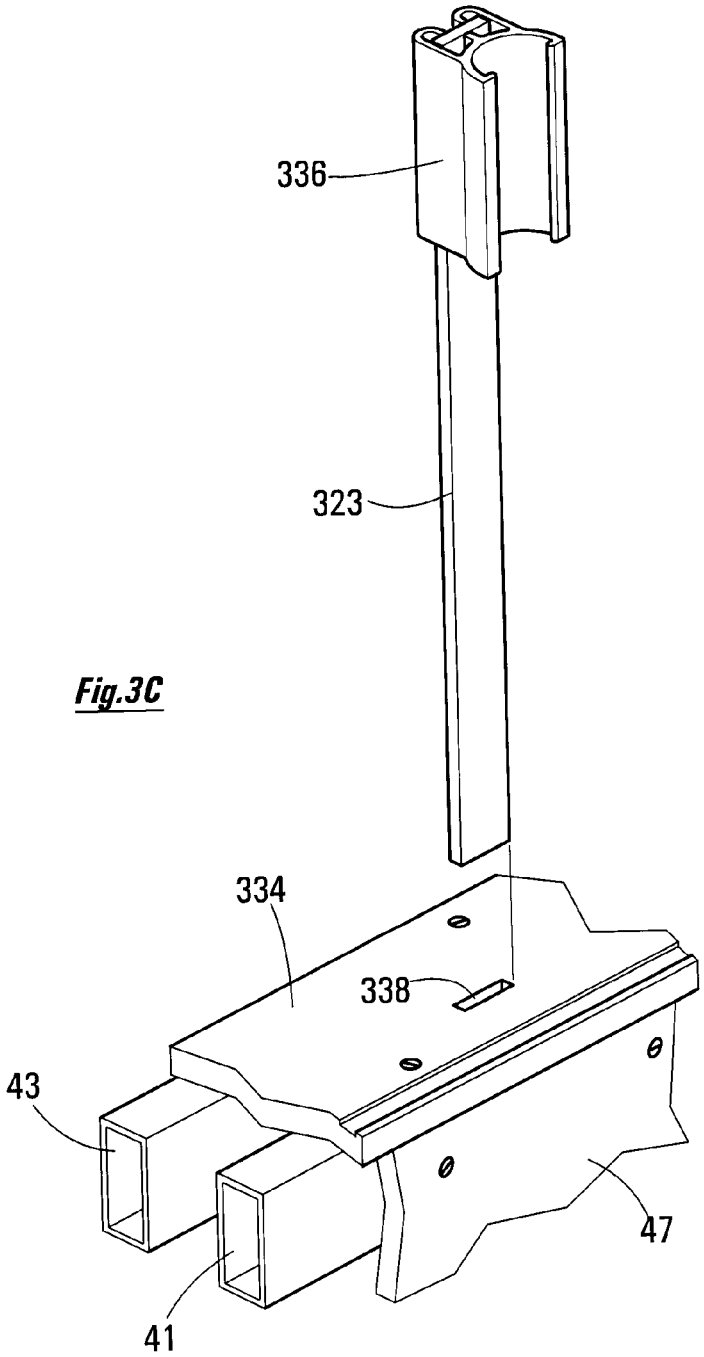
FIGS. 3C,3D,3E are pictorial views showing different assembly stages.
Figure 3D:
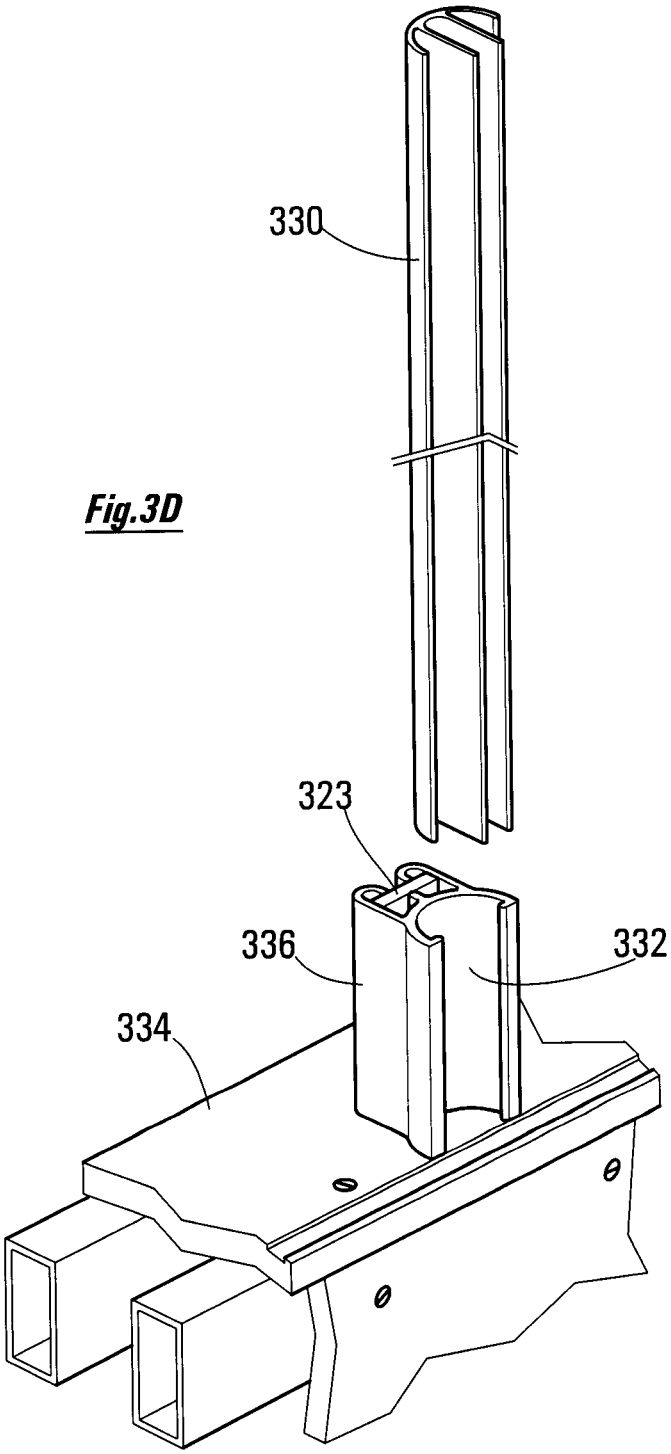

FIGS. 3C,3D,6E show stages in the assembly of some of the components of the bar-spring assembly of FIGS. 3A,3B. In FIG. 3C, the dasher-board 321 has been bolted into its allotted place in the ice-rink. The top-cap 334 is fixed (bolted) to the top-stringers. Now, the bar-spring 323 of the stanchion-support 325 (comprising the stanchion-base extrusion 336 and the bar-spring 323) is positioned over the aperture 338 in the top-cap 334. The bar-spring 323 is placed in the aperture 338, and the stanchion-support 325 is lowered until the stanchion-base extrusion 336 rests on top of the top-cap 334 (FIG. 3D). At this point, the bottom end of the bar-spring 323 engages a receptacle provided for the purpose in the frame of the dasher-board.

Figure 3E:
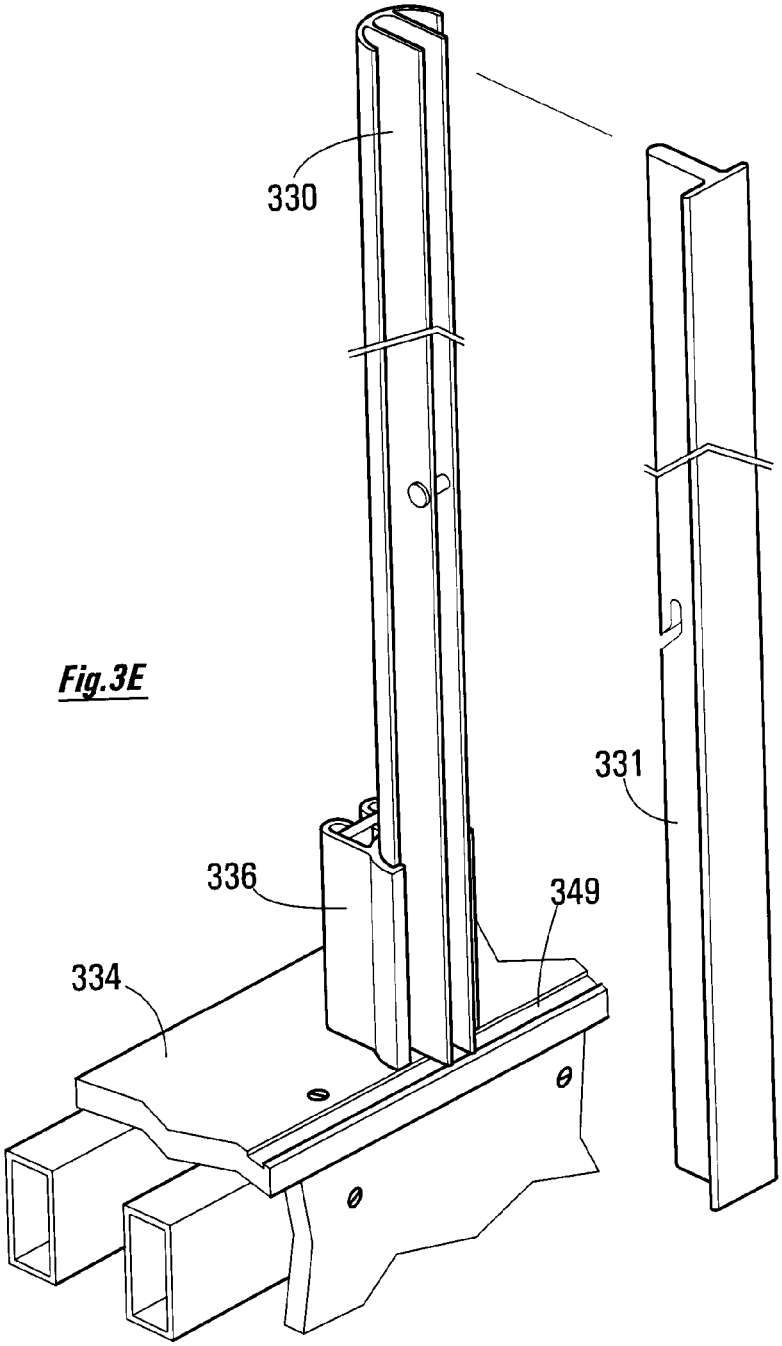

In FIG. 3E, the stanchion 330 has been lowered down into the socket 332 in the stanchion-base 336, until the stanchion 330 rests on top of the top-cap 334. Now, in FIG. 3E, the panes of glass 29 can be placed on the top-cap 334, with the bottom edge of the pane being placed in a pane-slot 349 in the top-surface of the top-cap 334. Two of the panes (not shown in FIG. 3E) are snugged up to the profile of the stanchion (in the manner as shown in FIG. 1D), and the retainer-strip 331 is clipped onto the stanchion 330 to hold the panes in place.

Much of this assembly operation consists in slotting components together, which can be done by unskilled workers, basically without tools. Disassembly, too, is just as simple.

In the assemblies thus far described, the glass panes have been secured to the dasher-boards using upright stanchions. The stanchions are fixed into the dasher-boards and the panes are fixed to the stanchions. However, upright stanchions, though slim, can interfere with the sight-view of persons outside the rink watching the game. Stanchion-less assemblies are common. As will be described, the use of the bar-springs as described herein, to permit the panes to "give", and absorb (some of) the impact, when a player crashes into the dasher-board assembly, can be applied also to the stanchion-less assemblies. An example is shown in FIGS. 4A,4B,4C.

Figure 4A:
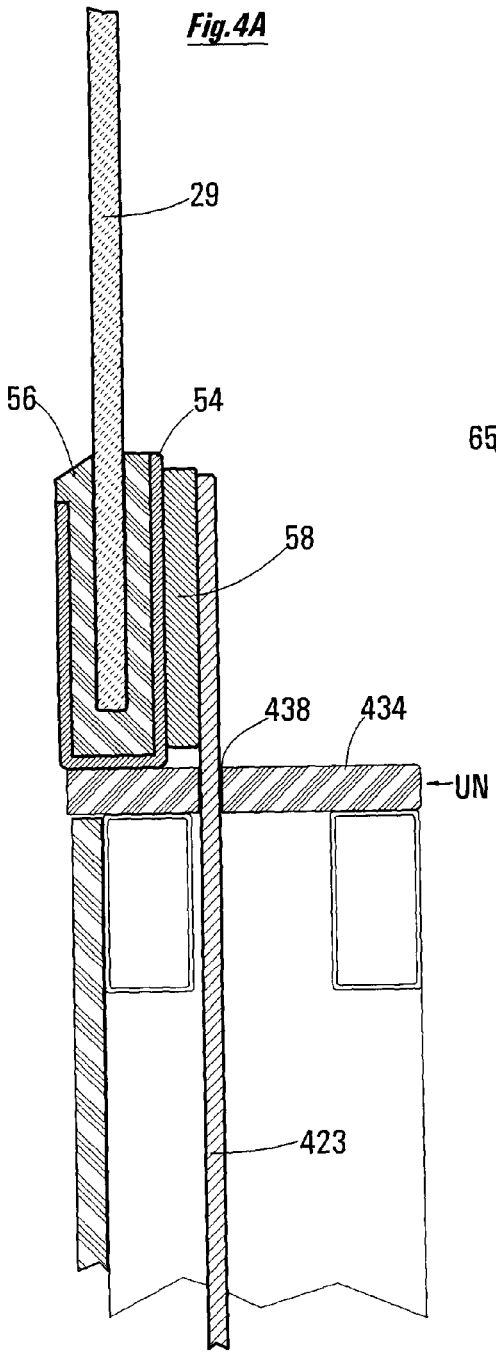
FIG. 4A is a sectioned side-elevation of yet another dasher-board assembly.
Figure 4B:
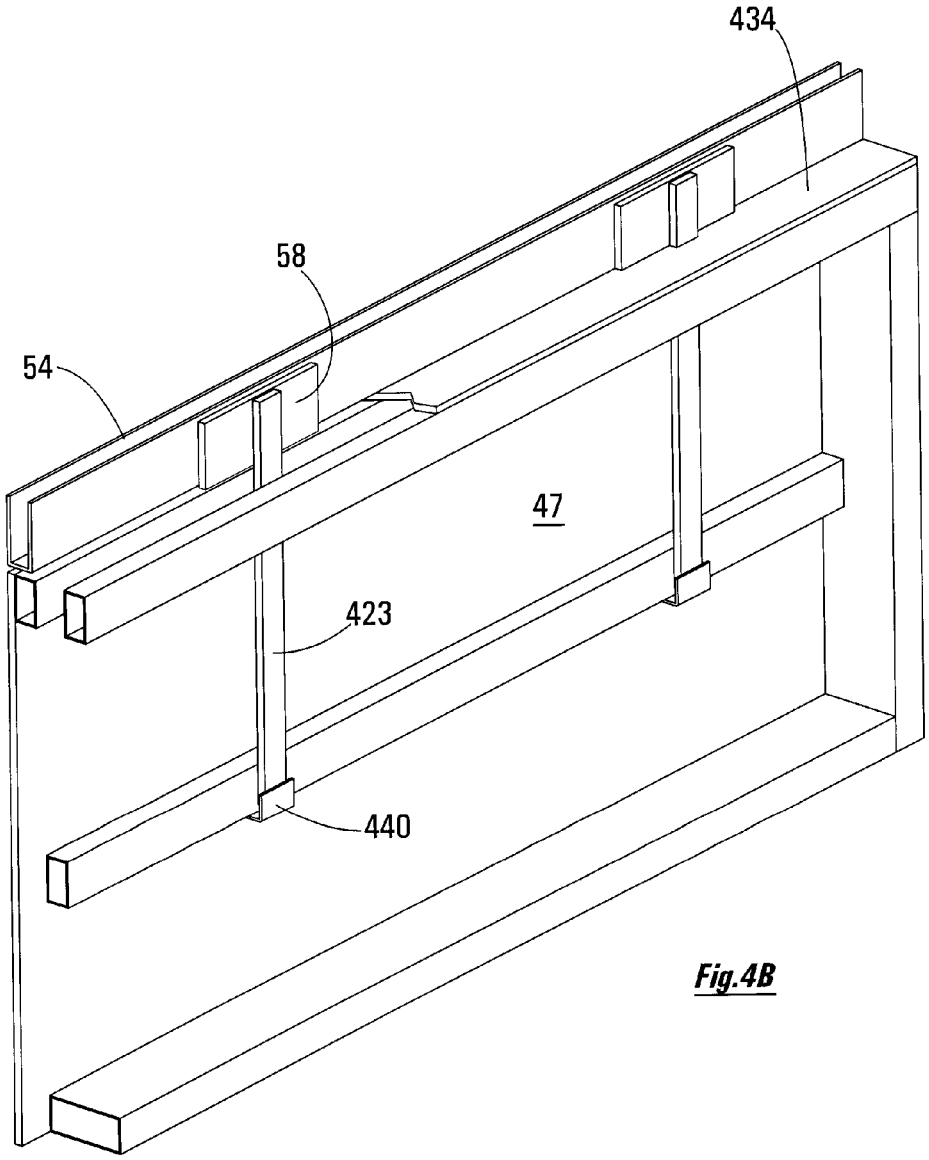
FIG. 4B is a pictorial view of the same.

In FIGS. 4A,4B, the pane-carrier is in the form of a glass-support trough or channel 54, which can be made from folded steel or as an extrusion, etc. A moulded plastic liner 56 fits inside the trough 54, and the glass pane 29 fits inside the plastic liner 56. A bar-spring 423 is fast to a spacer 58, which is fast to the trough 54.

When a player crashes into the dasher-board assembly, the bar-spring 423 deflects in a similar manner to that shown in FIG. 1B. That is to say, the bar-spring is constrained by an upper node and a lower node, and the bar-spring bows forwards (towards the ice) as the upper part of the bar-spring—above the upper node—angles backwards. The between-the-nodes portion of the bar-spring 423 undergoes bow-mode deflection.

The upper node is formed by the engagement of the bar-spring 423 with the aperture 438 in the plastic top-cap 434. The engagement prevents the bar-spring 423 from moving in the backwards direction, at the node-point. The mode of deflection of the bar-spring 423 means that, above the upper node-point the bar-spring moves backwards, while below the upper node-point the bar-spring moves forwards. (The upper and lower nodes are marked UN,LN on FIG. 1A and correspondingly on FIGS. 4A,6,7.) The dasher-board also includes a recoil abutment, which is structured so that, when the impact is finished, and the pane returns to its vertical unstressed position, the pane cannot overshoot and tip forwards.

As shown in FIG. 4A, the aperture 438 is formed in the plastic material of the top-cap 434. The aperture can be reinforced, if required. In an alternative, the aperture is formed in a metal component, and then that metal component is let into the top-cap, or is otherwise secured into the frame of the dasher-board.

Preferably, the bar-spring comprises a bar of spring steel, having the same cross-sectional size and shape at every point along its length, the bar being straight and flat in the unstressed condition of the bar-spring. The Boards may be expected to combine good resilient shock-absorbing qualities with good robustness when the dimensions of the spring-bar are: a thickness of 5 mm to 10 mm; a width of 25 mm to 38 mm; a between-nodes-length of at least 40 cm; and an above-upper-node-length of between 15 cm and 30 cm.

Figure 5:
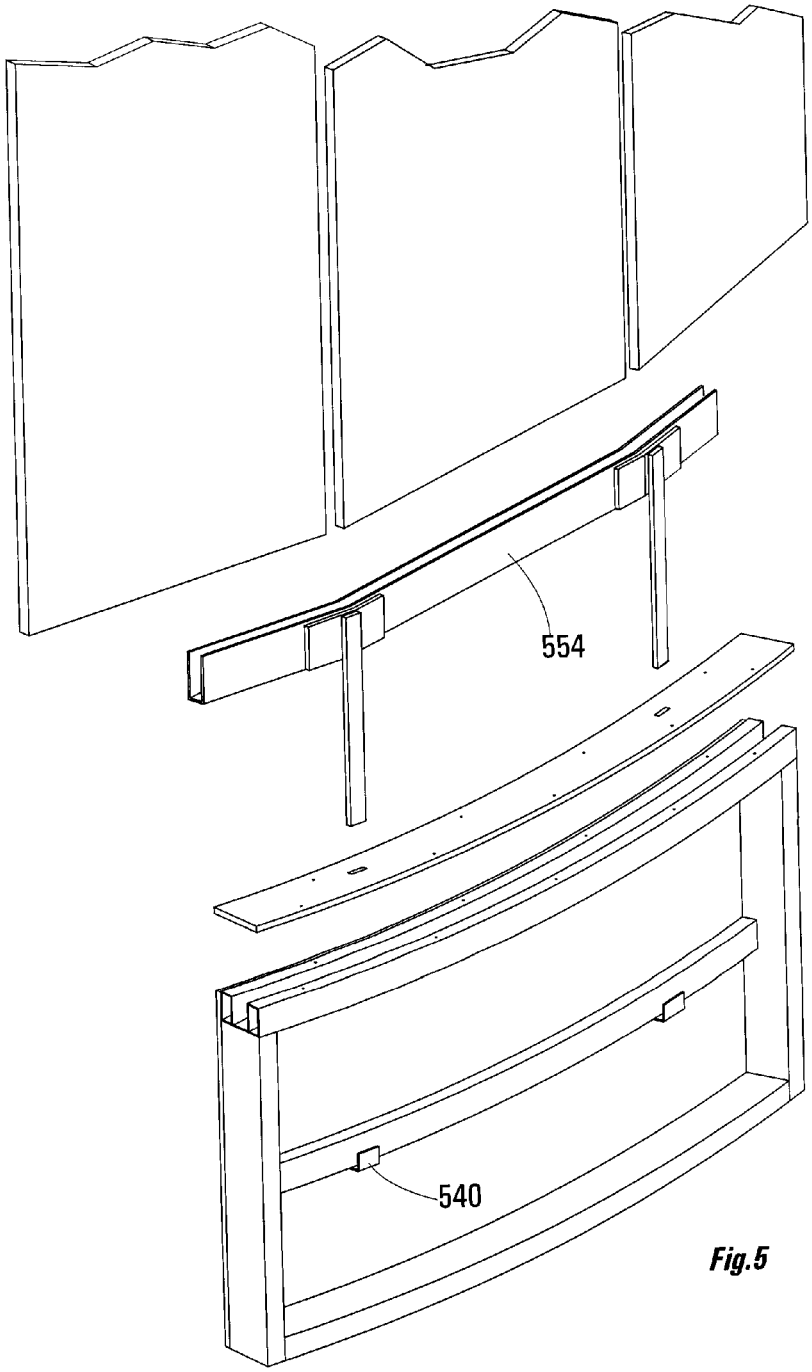
FIG. 5 is a pictorial view, which is similar to FIG. 4B, but shows a continuation dasher-board assembly, as appropriate to the curved corner area of the ice-rink.

FIG. 5 is similar to FIG. 4B, but shows a curved dasher-board. Curved dasher-boards are used in the corners of the rink. Generally, the glass used for the panes in the corners of the rink are higher (and therefore heavier) than the glass used for the straight areas. Generally, each glass pane is straight (flat-planar) even though the dasher-board itself is curved.

Alternatively, the corner panes can be curved. Generally, the panes are half the width of the dasher-boards, and the arrangement is that half the panes straddle between two dasher-boards, and the other half sit in the centre of their respective dasher-boards. The designers should see to it that the trough 556 and the trough-liners are robust enough to securely hold the panes, however arranged, without damage to the panes and troughs.

In FIGS. 1A-5, it is not intended that the troughs (and liners) should be removed from the dasher-boards, when the glass panes are removed and the dasher-boards are being taken up (e.g when the rink is being used for a non-ice event). However, the troughs can be simply lifted out, if removal is required.

Figure 6:
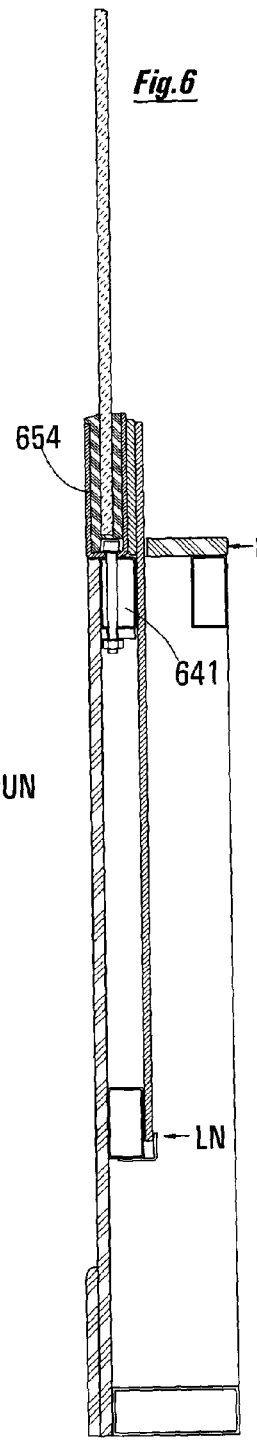
FIG. 6 (found with FIG. 4A) is a sectioned side-elevation of yet a further dasher-board assembly.

For added security, as shown in FIG. 6, the trough 654 may be bolted or otherwise made fast to the ice-side top stringer 641. The trough 654 has to be able to tip or rock backwards, and the bolt should be positioned to make it possible for the trough to undergo the required backwards rocking motion.

Figure 7:
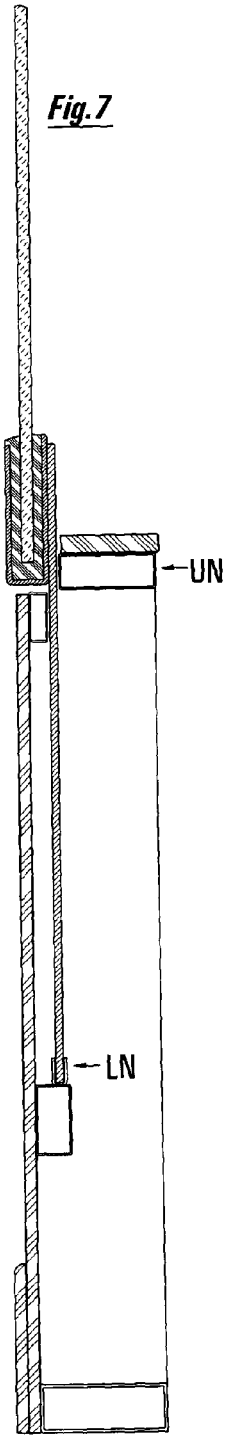
FIG. 7 is a sectioned side-elevation of still-further dasher-board assembly.

FIG. 7 shows another option. In some cases, the designers are concerned that the provision of a trough might encroach on the field of view of spectators. Removing the ice-side top-stringer, to make room for the trough, is not favoured as an option, because that significantly weakens the dasher-board. In FIG. 7, the ice-side top-stringer has been somewhat lowered, thereby providing a good compromise between dasher-board strength, and spectator viewability. However, the top-stringer should not be more than ten cm below the top-cap.

FIGS. 8-11A illustrate the technique for encapsulating the bar-springs in polyurethane, as in FIGS. 1A-1D. FIGS. 8,9 show the two leaves of the bar-spring 23 (which are weld-tacked together) being inserted into the shaped profile of the aluminum extrusion of the stanchion-base 36. The extrusion typically is 30 cm long, and at least one of the bars should be inserted at least 10 cm into the extrusion, or at least far enough that the flexing of the bar as shown in FIG. 1B can take place, without the extrusion moving (tipping, twisting, etc) relative to the bar.

FIG. 10 shows the mould, which is a semi-circular trough, with sides. A little of the liquid plastic is poured into the trough, and then the extrusion, with the bars, is placed into the liquid. Suitable supports (not shown) are provided in order to keep the metal pieces properly spaced from the walls of the mould, to ensure the desired thickness of plastic. Then, the rest of the liquid plastic is poured in. The components remain in the mould during (oven) curing of the plastic.

Encapsulation of the bar-spring in a plastic moulding is preferred, but is not essential. In e.g FIG. 1B, the plastic encapsulation makes the stanchion-base and the bar-springs all of a piece. The plastic serves also to cushion some of the shocks and impacts that would otherwise be felt between the bars and the aperture in the top-cap.

In general, in the technology described herein, the glass panes are mounted in a pane-carrier, and the pane-carrier is carried on a bar-spring. The bar-spring allows or enables the panes to rock backwards relative to the dasher-board, and thus to absorb much of the impact when a player crashes into the boards. Two examples of pane-carriers are described, being upright stanchions and bottom-edge-receiving troughs.

The bar-spring is fast to the pane-carrier. The bar-spring doubles as the provider of shock-absorbing resilience, and as the provider of the mechanical support needed to hold the pane in its designed location with respect to the frame of the dasher-board. The frame and the pane-carrier interact at upper and lower nodes. The frame constrains the bar-spring against translational movement, in the back-front sense, at the nodes.

Although the bar-spring is constrained, at its upper-node-point, against translational movement relative to the frame of the dasher-board, the bar-spring is free, at its upper-node-point, to undergo rocking or tipping movement relative to the frame of the dasher-board.

Between the nodes, the bar-spring can undergo bow-mode deflection. That is to say, the bar-spring is deflectable in bow-mode bending, in which the maximum deflection of the bar-spring occurs midway between the nodes. It is recognized that a bar-spring, configured as described herein, can be robust enough to serve as the mechanical support for the pane-carrier and the panes, and at the same time can be made to have the required spring characteristics, such as spring-rate, force-capacity, etc. In the new design, the stresses arising from the player-impact are fed into the bar-spring, and the bar-spring then feeds the stresses gently into the frame of the dasher-board.

The expression "fast to" is used herein, in the context "P is fast to Q". This means that during operation, and especially when a player is crashing into the boards, the components P,Q do not, and cannot, move relative to each other. They are firmly and securely fixed or attached, as if they were monolithic. On the other hand, the two components may be said to be fast to each other, even though the two components can be disassembled from each other without tools.

Unless otherwise stated, the movements and deflections of the components of the dasher-board assembly, as referred to in this specification, are movements and deflections that occur in response to a player crashing into the dasher-board assembly.

The expression "flush-mounted" is used herein to refer to the position of the glass-pane with respect to the front panel of the dasher-board. This condition is defined as follows. The glass is flush-mounted if, in the dasher-board assembly, there are no significant protrusions that are closer to the ice than the front (ice-side) surface of the glass. The main type of protrusion, in conventional not-flush-mounted dasher-board assemblies, is the protruding ledge or land of the top-cap.

A protrusion is said to be significant if protrudes, in the towards-the-ice direction, more than 3½ centimeters, measured from the ice-side face of the pane. A protrusion, or a portion of a protrusion, is said to be upwards-facing insofar as it lies at an angle of 45° or less to the horizontal.

The pane cannot move or rock with respect to the pane-carrier. That is to say: the pane being mounted in the pane-carrier, the pane-carrier constrains the foot of the pane, to the extent that the pane and the pane-carrier, during operation, can undergo neither relative translational movement in a horizontal sense, nor relative tipping or rocking movement.

Preferably, the upper node is either in the back-side top-stringer, or is in a component that is fast to that stringer. Advantageously, the upper node is formed in the top-cap which is bolted to the stringer. Preferably, the top-cap is formed with a through-aperture, and the bar-spring passes through, and lies in, the through-aperture. The upper node-point is a point on the bar-spring that lies in contact with a wall of the aperture, and the upper node-abutment is the wall of the aperture.

It is advantageous for the dasher-board to be so configured that the bar-spring passes down between the two top-stringers, and that the lower node-abutment is formed in a lower-stringer.

The dimensions of the bar-spring should be such that the deflection of the bar-spring—at a point midway between the two nodes—is between 15 mm and 25 mm when the above-the-upper-node portion of the bar-spring is subjected to a torque of 500 N-m.

The numerals used in the drawings may be summarized as:

20 dasher-board assembly
21,321 dasher-board
23,223,323,423 bar-springs, component of stanchion-support
25,325 stanchion-support
27 plastic encapsulation, component of stanchion-support
29 panes of glass
30,330 stanchion
31,331 retainer-strips
32,332 socket in stanchion-base, for receiving stanchion
34,234,334,434 top-cap or sill of dasher-board
36,336 stanchion-base, component of stanchion-support
38,238,338,438 aperture in top-cap, to receive bar-spring
40,340,440,540 fixed receptacle, in dasher-board frame
41,641 ice-side top stringer
43 back-side top stringer
45 round bars
47 front panel
49,349 slot in top-cap, for receiving bottom of glass pane
54,554,654 trough or channel, for receiving bottom of glass pane
56 plastic liner
58 spacer Herein, some of the features of the technology are depicted and described in relation to one type of dasher-board and not in relation to another. It should be understood that all the features can be applied to all the types of dasher-boards, where that is possible, or unless otherwise stated.

The scope of protection sought herein is defined by the accompanying claims. The hardware structures depicted and described in the drawings and description should be regarded as examples.

The invention claimed is:

1. Dasher-board for use with a glass pane, to form a dasher-board assembly, wherein:

the dasher-board includes a flexible bar-spring, which is so arranged in the dasher-board as to be free to undergo significant deflection from an unstressed condition to a stressed condition, and to resiliently return to its unstressed condition;

upper and lower node-abutments are formed in a frame of the dasher-board;

the node-abutments interact with the bar-spring to constrain upper and lower node-points of the bar-spring from undergoing translational movement in a horizontal sense relative to the frame;

the bar-spring is so mounted and arranged in the dasher-board that:

(a) a between-nodes-length of the bar-spring is free to undergo bow-mode deflection movement relative to the frame;

(b) an above-upper-node-length of the bar-spring is free to undergo tipping or rocking deflection movement relative to the frame;

the dasher-board includes a pane-carrier, which is fast to the above-upper-node-length of the bar-spring;

the dasher-board is so structured:

(a) that the pane-carrier has the capability to receive a glass pane;

(b) that, a pane having been received in the pane-carrier, the pane and the pane-carrier are free to undergo substantial tipping or rocking movement relative to the frame of the dasher-board, but only in unison with each other; and (c) that such tipping or rocking movement of the pane and pane-carrier is accompanied by significant deflection of the bar-spring between its unstressed and stressed conditions.

2. A dasher-board as claimed in claim 1, wherein:

the pane being mounted in the pane-carrier, the pane-carrier constrains the foot of the pane, to the extent that the pane and the pane-carrier cannot, during operation, undergo:

(a) relative translational movement in a horizontal sense; and (b) relative tipping or rocking movement.

3. A dasher-board as claimed in claim 1, wherein the upper node-abutment is either:

formed in a back-side top-stringer, which is a fixed component of the frame of the dasher-board; or formed in a top-cap that is itself firmly fixed to the back-side top-stringer; or formed in a separate component that is itself firmly fixed either to the top-cap or to the back-side top-stringer.

4. A dasher-board as claimed in claim 1, wherein:

the frame of the dasher-board includes a top-stringer, and a plastic top-cap is fast to the top-stringer;

the top-cap is formed with a through-aperture;

the bar-spring has passed through and lies in the through-aperture;

the upper node-point is a point on the bar-spring that lies in cotact with a wall of the aperture, and the upper node-abutment is the wall of the aperture.

5. A dasher-board as claimed in claim 1, wherein:

the frame of the dasher-board includes an ice-side top-stringer and a back-side top-stringer, and includes a space therebetween;

the bar-spring lies in the space between the two top-stringers, and thence passes down inside the frame to a lower-stringer;

the lower node-abutment is formed in the lower-stringer.

6. A dasher-board as claimed in claim 1, wherein:

the bar-spring comprises a bar of spring steel, having the same cross-sectional size and shape at every point along its length;

the bar is straight and flat in the unstressed condition of the bar-spring;

the bar has a thickness of between 5 mm and 10 mm;

the bar has a width of between 25 mm and 38 mm;

the bar has a between-nodes-length of at least 40 cm;

the bar has an above-upper-node-length of between 15 cm and 30 cm.

7. A dasher-board as claimed in claim 6, wherein the bow-mode elasticity of the bar is defined in that, in response to a torque of 500 N-m applied to the above-upper-node-length of the bar, the bow-mode deflection of the bar, as measured at an anti-node that arises midway between the upper and lower node-points of the bar, is between 15 mm and 25 mm.

8. A dasher-board as claimed in claim 1, wherein:

the bar-spring comprises two or more separate leaves of spring steel.

9. A dasher-board as claimed in claim 8 wherein:

the leaves together have a bow-mode elasticity defined in that, in response to a torque of 500 N-m applied to the above-upper-node-length of the bar, the bow-mode deflection of the bar, as measured at an anti-node that arises midway between the upper and lower node-points of the bar, is between 15 mm and 25 mm.

10. A dasher-board as claimed in claim 1, wherein the pane-carrier is so arranged in the dasher-board that, a glass pane having been mounted in the pane-carrier, the ice-side of said pane lies flush or almost flush with the ice-facing side of the dasher-board.

11. A dasher-board as claimed in claim 1, wherein:

the pane-carrier includes an upright stanchion, which is structured to receive side edges of left and right glass panes into left and right grooves of the stanchion;

a lower end of the stanchion is fast to the above-upper-node-length of the bar-spring.

12. A dasher-board as claimed in claim 11, wherein:

the pane-carrier includes also a stanchion-base;

the above-upper-node-length of the bar-spring is fast to the stanchion-base;

the stanchion-base is formed with a stanchion-socket, into which a lower end of the stanchion is received.

13. A dasher-board as claimed in claim 12, wherein the stanchion-base, the stanchion, and the glass pane, rest each in weight-supporting contact with the top-cap of the dasher-board.

14. A dasher-board as claimed in claim 12, wherein the bar-spring is made fast to the stanchion-base in that the stanchion-base is formed with a receptacle, and the bar-spring is an interference fit in the receptacle.

15. A dasher-board as claimed in claim 1, wherein the bar-spring is encapsulated in moulded plastic.

16. A dasher-board as claimed in claim 1, wherein:

the pane-carrier includes a horizontal trough, which is structured to receive a bottom edge of the glass pane;

the trough is so structured that, the pane being so received, the trough constrains the pane against relative rotational and translational movement; and the bar-spring is fast to the trough.

* * * * *